US005945960A

United States Patent [19]

Luh

[11] Patent Number: 5,945,960

[45] Date of Patent: Aug. 31, 1999

[54] METHOD AND APPARATUS FOR RECONFIGURING ANTENNA RADIATION PATTERNS

[75] Inventor: Howard H. S. Luh, Sunnyvale, Calif.

[73] Assignee: Space Systems/Loral, Inc., Palo Alto, Calif.

[21] Appl. No.: 08/758,968

[22] Filed: Dec. 2, 1996

[51] Int. Cl.[6] ..... H01Q 3/00; H01Q 3/12

[52] U.S. Cl. ..... 343/757; 343/761; 343/882

[58] Field of Search ..... 343/756, 761, 343/781 P, 915, 757, 711, 754, 766, 882

[56] References Cited

U.S. PATENT DOCUMENTS

| | | | |
|---|---|---|---|
| 4,070,678 | 1/1978 | Smedes | 343/754 |
| 4,949,092 | 8/1990 | Crail et al. | 342/354 |
| 5,229,781 | 7/1993 | Losquadro et al. | 343/766 |
| 5,440,320 | 8/1995 | Lach et al. | 343/915 |
| 5,528,250 | 6/1996 | Sherwood et al. | 343/765 |
| 5,581,265 | 12/1996 | Stirland et al. | 343/756 |
| 5,673,057 | 9/1997 | Toland et al. | 343/761 |

*Primary Examiner*—Don Wong
*Assistant Examiner*—Hoang Nguyen
*Attorney, Agent, or Firm*—Perman & Green, LLP

[57] ABSTRACT

An antenna is shaped to provide a predetermined contour and is mounted for universal movement on its support. An electronically controlled drive mechanism is operatively associated with the antenna to rotate the antenna to preselected positions corresponding to specific target locations. A fixed feed horn excites the antenna to generate a first radiation pattern which conforms to the shape of a primary desired target location when the antenna is moved to a first position and a second radiation pattern which conforms to the shape of a secondary desired target location when the antenna is moved to a second position. By further designing the antenna shape, multiple contoured beams for multiple target locations are obtained.

6 Claims, 2 Drawing Sheets

METHOD AND APPARATUS FOR RECONFIGURING ANTENNA RADIATION PATTERNS

BACKGROUND OF THE INVENTION

There are many satellites presently in geosynchronous orbit to facilitate communications with and surveillance of specific land masses. It is important to form the beams to the shape of the geographic target so as not to waste the gain of the antenna being used. Contoured beam antenna systems are used on these satellites to conform the beam to the target.

Antenna used for surveillance or communications satellites need to be shaped to provide a target pattern which conforms as closely as possible to the shape of the target location. This maximizes the power directed at the target and increases the response of the associated system. In order to accommodate multiple targets, multiple antenna radiation patterns must be generated. Prior art systems utilized a reflector antenna with a feed array which is connected to a power source through a variable power driver beam forming network. By proper excitation of the feed array, the antenna radiation pattern can be changed. The problem, however, is in the beam forming network, which is a major source of passive intermodulation interference. The beam forming network also adds considerable weight and expanse to the system.

It is the purpose of this invention to generate multiple contoured beams utilizing a single antenna and feed.

SUMMARY OF THE INVENTION

An antenna is shaped to provide a predetermined contour and is mounted for universal movement on its support. An electronically controlled drive mechanism is operatively associated with the antenna to rotate the antenna to preselected positions corresponding to specific target locations. A fixed feed horn excites the antenna to generate a first radiation pattern which conforms to the shape of a primary desired target location when the antenna is moved to a first position and a second radiation pattern which conforms to the shape of a secondary desired target location when the antenna is moved to a second position. By further designing the antenna shape, multiple contoured beams for multiple target locations are obtained.

DESCRIPTION OF THE DRAWING

This invention is described in more detail below with reference to the drawing in which.

DESCRIPTION OF THE INVENTION

Figure 1:
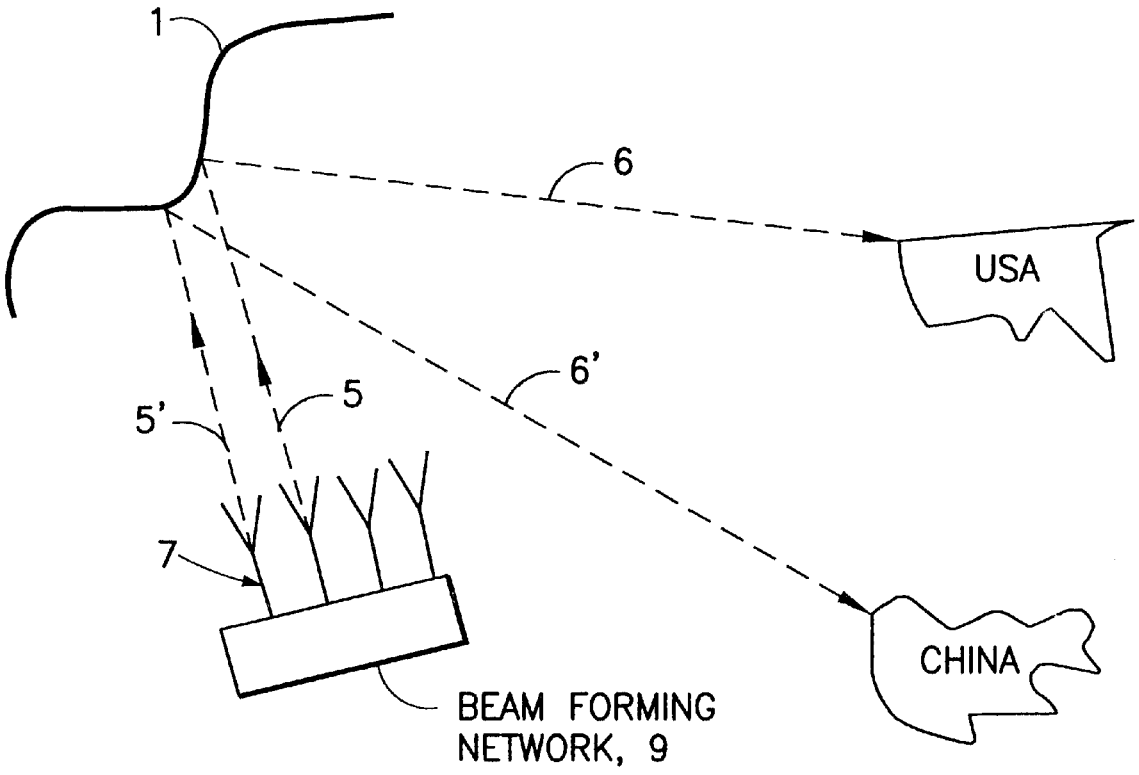
FIG. 1 PRIOR ART
FIG. 1 is a schematic diagram of a multiple feed horn system of the prior art.

As shown in FIG. 1, prior art systems consist of a shaped reflector 1 and a radio frequency feed array 7. A beam forming network 9 powers the feed array 7 and switches the feed to reconfigure the reflected beam. The feed array directs radio frequency energy 5 and 5' at the reflector to form beams 6 and 6' contoured to the shape of the targets 4 or 4' to focus the energy in the desired location. By focusing the beam to the shape of the target, antenna gain is optimized. This type of system is unnecessarily complex and adds much weight and expense to the satellite.

To provide the necessary multiple contoured beams, the reflecting surface of antenna 1 is shaped having a node 8. The reflecting surface shape is designed using available optimizer computer techniques for analyzing horn feed reflector antenna systems. The antenna 1 is mounted at 2 for universal movement about the axis' x—x, y—y, and z—z. The mounting means may be any suitable gimbal type mount that allows a complete flexibility of movement. In addition further movement may be provided by mounting the gimbal mount on a sliding track for translation along, for example the axis x—x.

Figure 2:
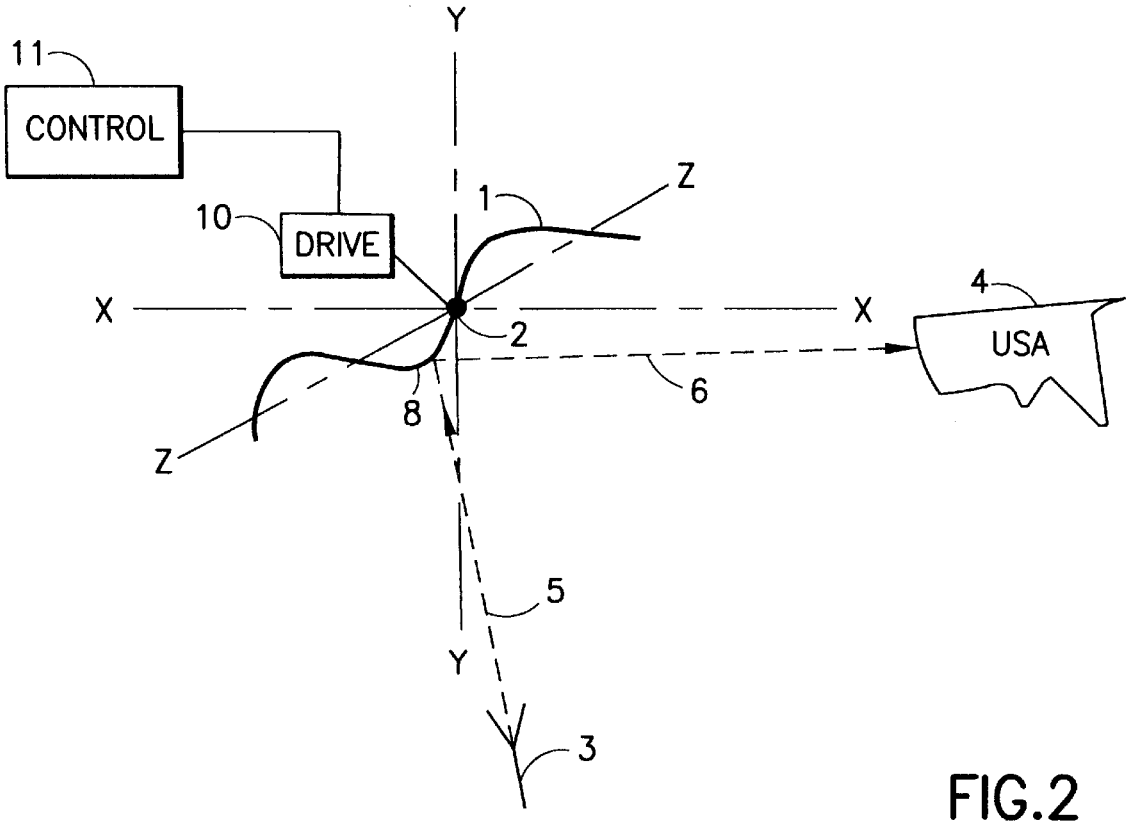
FIG. 2 is a schematic diagram of a moveable shaped antenna in a first position with a single fixed feed horn used to form a contoured beam directed at the U.S.A. as used in the invention.
Figure 3:
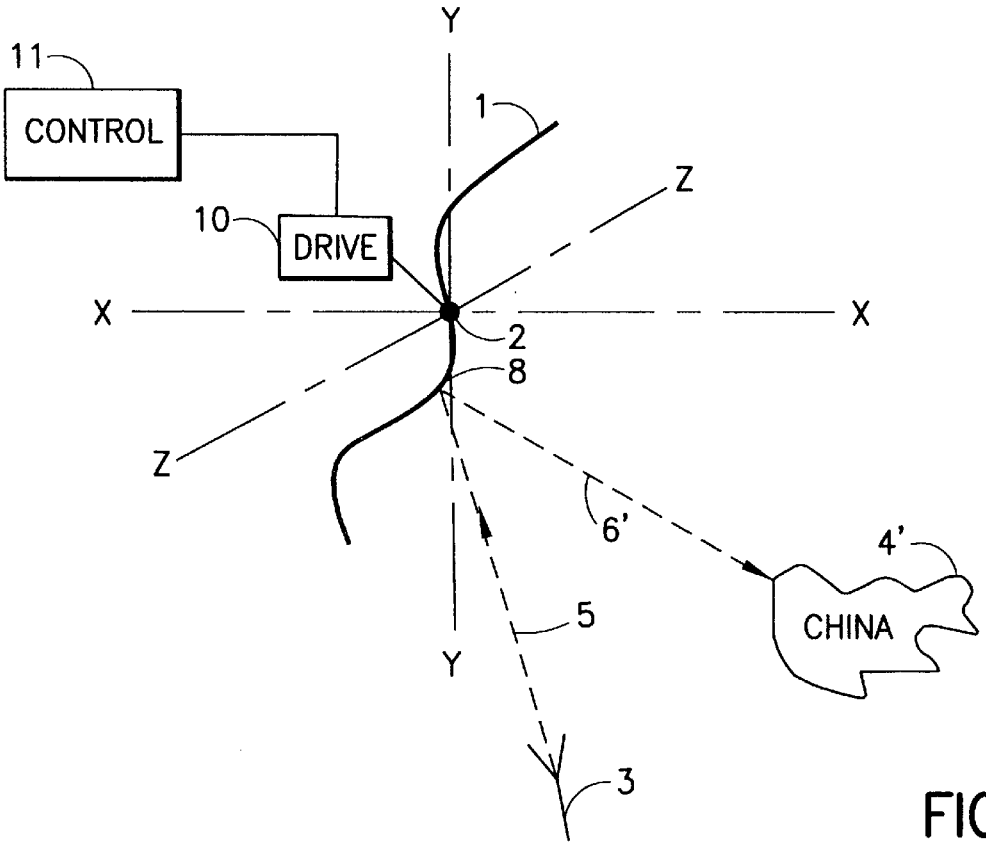
FIG. 3 is a schematic diagram of a moveable shaped antenna in a second position with a single fixed feed horn used to form a contoured beam directed at China as used in the invention.

In addition a drive mechanism 10 is provided to move the antenna between at least two positions in order to provide the multiple beams upon receiving signals from a control 11. Control 11 can be the onboard computer, separate discrete logic, or a microprocessor depending on the complexity of the control required. As shown in FIGS. 2 and 3, as an example, the system of this invention is configured to radiate contoured patterns which conform to the location and shape of the U.S.A. and China when moved from a first position to a second position.

Radiation feed horn 3 is placed at a fixed location, a predetermined distance from and angle to the antenna 1. The feed horn is designed to excite the antenna to radiate a contoured beam for each target. When the antenna is moved from one position to another the feed energy excites a different portion of node 8.

In operation the antenna 1 is positioned by actuating the drive mechanism 10 through control 11 to a predetermined orientation relative to the feed horn 3. Radiation beam 5 excites the antenna 1 at one side of node 8 to reflect a contoured beam 6 conforming to the shape and location of a first target, for example the U.S.A. As the satellite continues its orbit, a second target, for example China will come into its range. Control 11 will activate the drive mechanism 10 to move the antenna to a second predetermined position relative to feed horn 3. Radiation beam 5 is emitted from feed horn 3 to excite the antenna 1 at a different point on node 8 and excite antenna 1 to reflect a second contoured beam 6' conforming to the shape and location of China. The contoured beams 6 and 6' are the result of the predetermined shape of the antenna 1 in conjunction with the fixed exciting energy of feed horn 3.

In this manner a simple, inexpensive, and light system is provided to transmit multiple contoured beams utilizing a single antenna and feed. This is accomplished while eliminating the interference inherent in prior art systems.

I claim:

1. Apparatus for reconfiguring an antenna system for radiating a contoured beam to multiple targets comprising:

a single reflector antenna having different reflective surface portions constructed therein, each of said different reflective surface portions shaped to radiate a different contoured beams, said beams corresponding to different predetermined targets, when each of said surface portions is excited by a source of energy, said antenna secured to mounting means;

a single energy feed, designed to excite the antenna surface portion upon which it impinges, said feed being fixed in a predetermined relation with each of said different antenna surface portions; and mounting means to receive the antenna and to allow the antenna to move to at least two different positions relative to the energy feed, wherein one of said reflective surface portions upon which the energy feed impinges is excited to radiate one of said different contoured beams, each of said antenna positions corresponding respectively to a different target.

2. Apparatus for reconfiguring an antenna system for radiating a contoured beam as described in claim 1 further comprising:

control means to generate a signal to initiate movement of the antenna; and drive means operatively connected to the mounting means to move the antenna from one position to another in response to the signal from the control means.

3. Apparatus for reconfiguring an antenna system for radiating a contoured beam to multiple targets as described in claim 1 wherein the mounting means comprises a gimbal mount to provide universal movement for the antenna.

4. Apparatus for reconfiguring an antenna system for radiating a contoured beam to multiple targets as described in claim 1 wherein the antenna is mounted on a satellite in geosynchronous orbit and the control means comprises the on board satellite computer which generates the signal to reposition the antenna relative to the feed at predetermined points in its orbit.

5. Apparatus for reconfiguring an antenna system for radiating a contoured beam to multiple targets as described in claim 1 wherein the mounting means comprises a track to provide sliding motion for the antenna.

6. A method of reconfiguring an antenna to provide a contoured beam to multiple targets comprising the steps of:

mounting a single antenna having a reflecting surface for movement between at least a first position and a second position;

shaping the reflecting surface to have different surface portions exposed to impingement by an energy feed in the first and second positions;

placing a single energy feed in operative position with the antenna, said feed being in fixed spatial relation to each of the different antenna portions;

moving the reflecting antenna to the first position at which the feed impinges on one of said antenna surface portions;

exciting one of the antenna surface portions by impinging the energy feed on the antenna in its first position to generated a first contoured beam corresponding in shape and location to a first target;

moving the reflecting antenna to the second position at which the feed impinges on another antenna surface portion in the second position to excite a different portion of the antenna surface; and exciting the different antenna surface portion at the second position by energizing the feed when the antenna is in its second position to generated a second contoured beam corresponding in shape and location to a second target.

* * * * *